US006485505B1

(12) United States Patent
Vasquez

(10) Patent No.: US 6,485,505 B1
(45) Date of Patent: Nov. 26, 2002

(54) PACIFIER COVER

(76) Inventor: Bonnie L. Vasquez, 4330 Utah St. #2, San Diego, CA (US) 92104

( * ) Notice: Subject to any disclaimer, the term of this patent is extended or adjusted under 35 U.S.C. 154(b) by 53 days.

(21) Appl. No.: 09/785,126

(22) Filed: Feb. 16, 2001

(51) Int. Cl.[7] ..... A61J 17/90
(52) U.S. Cl. ..... 606/234
(58) Field of Search ..... 606/234–236; 215/11.6; 280/507

(56) References Cited

U.S. PATENT DOCUMENTS

| | | | | | |
|---|---|---|---|---|---|
| 1,191,516 | A | * | 7/1916 | Keil | 215/11.6 |
| 1,414,268 | A | * | 6/1922 | Alvey | 215/11.6 |
| 2,579,194 | A | * | 12/1951 | Kronish | 215/11.6 |
| 2,860,639 | A | | 11/1958 | Hoover | |
| 4,181,320 | A | * | 1/1980 | Wellborn, Jr. | 280/507 |
| 4,329,996 | A | | 5/1982 | Copeland | |
| 4,417,613 | A | * | 11/1983 | Ryan et al. | 206/438 |
| 4,493,324 | A | | 1/1985 | Johnston | |
| 4,852,569 | A | * | 8/1989 | Sanders | 606/234 |
| 4,946,054 | A | | 8/1990 | Maniero et al. | |
| 5,156,617 | A | | 10/1992 | Reid | |
| 5,571,140 | A | * | 11/1996 | Gura-Emerling | 606/236 |
| D409,309 | S | | 5/1999 | Tollman | |

FOREIGN PATENT DOCUMENTS

| | | | | |
|---|---|---|---|---|
| WO | WO 94/28857 | * | 12/1994 | 606/234 |

* cited by examiner

*Primary Examiner*—Eric F. Winakur

(57) ABSTRACT

A pacifier cover for removably storing a pacifier to prevent debris from coming in contact with the nipple of the pacifier. The pacifier cover includes a casing. The casing has a top wall having a peripheral edge. A peripheral wall is integrally coupled to and extends away from the peripheral edge of the top wall. The peripheral wall has a free edge. The free edge defines an opening into the casing. The casing is comprised of a resiliently elastic material. A pacifier may be extended through the opening and into the casing.

10 Claims, 2 Drawing Sheets

PACIFIER COVER

BACKGROUND OF THE INVENTION

1. Field of the Invention

The present invention relates to pacifier covers and more particularly pertains to a new pacifier cover for removably storing a pacifier to prevent debris from coming in contact with the nipple of the pacifier.

2. Description of the Prior Art

The use of pacifier covers is known in the prior art. More specifically, pacifier covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,946,054; 4,493,324; U.S. Des. Pat. No. 409,309; U.S. Pat. Nos. 2,860,639; 4,329,996; and 5,156,617.

While these devices fulfill their respective, particular objectives and requirements, the aforementioned patents do not disclose a new pacifier cover. The inventive device includes a casing. The casing has a top wall having a peripheral edge. A peripheral wall is integrally coupled to and extends away from the peripheral edge of the top wall. The peripheral wall has a free edge. The free edge defines an opening into the casing. The casing is comprised of a resiliently elastic material. A pacifier may be extended through the opening and into the casing.

In these respects, the pacifier cover according to the present invention substantially departs from the conventional concepts and designs of the prior art, and in so doing provides an apparatus primarily developed for the purpose of removably storing a pacifier to prevent debris from coming in contact with the nipple of the pacifier.

SUMMARY OF THE INVENTION

In view of the foregoing disadvantages inherent in the known types of pacifier covers now present in the prior art, the present invention provides a new pacifier cover construction wherein the same can be utilized for removably storing a pacifier to prevent debris from coming in contact with the nipple of the pacifier.

The general purpose of the present invention, which will be described subsequently in greater detail, is to provide a new pacifier cover apparatus and method which has many of the advantages of the pacifier covers mentioned heretofore and many novel features that result in a new pacifier cover which is not anticipated, rendered obvious, suggested, or even implied by any of the prior art pacifier covers, either alone or in any combination thereof.

To attain this, the present invention generally comprises a casing. The casing has a top wall having a peripheral edge. A peripheral wall is integrally coupled to and extends away from the peripheral edge of the top wall. The peripheral wall has a free edge. The free edge defines an opening into the casing. The casing is comprised of a resiliently elastic material. A pacifier may be extended through the opening and into the casing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pacifier cover apparatus and method which has many of the advantages of the pacifier covers mentioned heretofore and many novel features that result in a new pacifier cover which is not anticipated, rendered obvious, suggested, or even implied by any of the prior art pacifier covers, either alone or in any combination thereof.

It is another object of the present invention to provide a new pacifier cover which may be easily and efficiently manufactured and marketed.

It is a further object of the present invention to provide a new pacifier cover which is of a durable and reliable construction.

An even further object of the present invention is to provide a new pacifier cover which is susceptible of a low cost of manufacture with regard to both materials and labor, and which accordingly is then susceptible of low prices of sale to the consuming public, thereby making such pacifier cover economically available to the buying public.

Still yet another object of the present invention is to provide a new pacifier cover which provides in the apparatuses and methods of the prior art some of the advantages thereof, while simultaneously overcoming some of the disadvantages normally associated therewith.

Still another object of the present invention is to provide a new pacifier cover for removably storing a pacifier to prevent debris from coming in contact with the nipple of the pacifier.

Yet another object of the present invention is to provide a new pacifier cover which includes a casing. The casing has a top wall having a peripheral edge. A peripheral wall is integrally coupled to and extends away from the peripheral edge of the top wall. The peripheral wall has a free edge. The free edge defines an opening into the casing. The casing is comprised of a resiliently elastic material. A pacifier may be extended through the opening and into the casing.

Still yet another object of the present invention is to provide a new pacifier cover that has a size and shape adapted for retrofittably receiving existing pacifiers.

Even still another object of the present invention is to provide a new pacifier cover that has fingers thereon which hold the pacifier in the casing and yet are easy to maneuver around in order to remove the pacifier.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
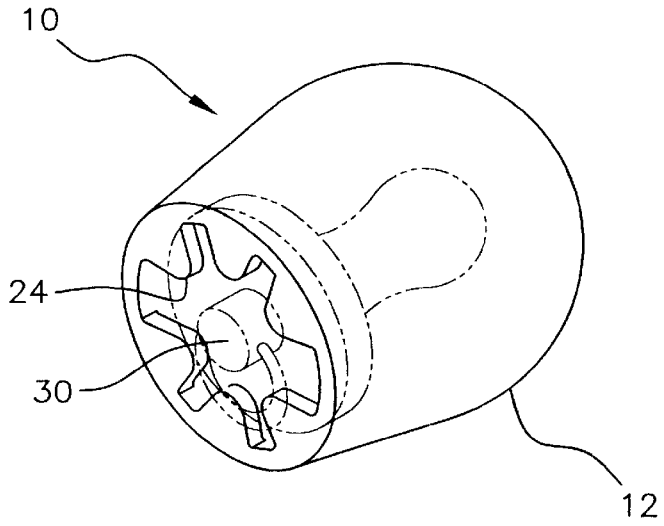
FIG. 1 is a schematic perspective view of a new pacifier cover according to the present invention.
Figure 2:
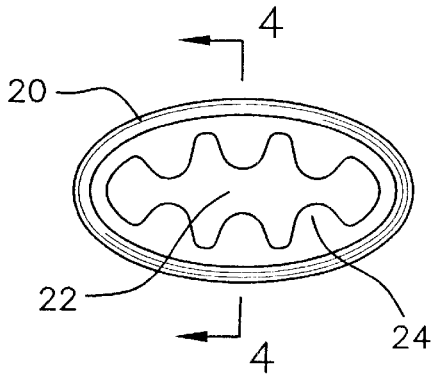
FIG. 2 is a schematic end view of the present invention.
Figure 3:
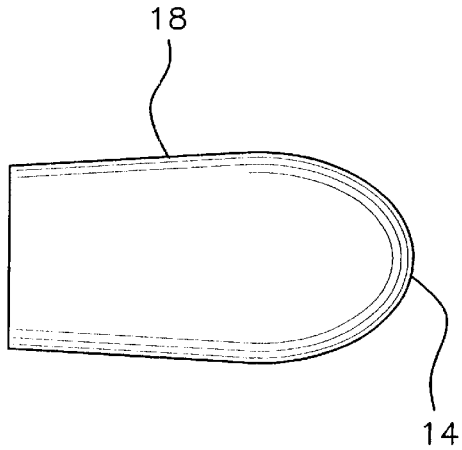
FIG. 3 is a schematic side view of the present invention.
Figure 4:
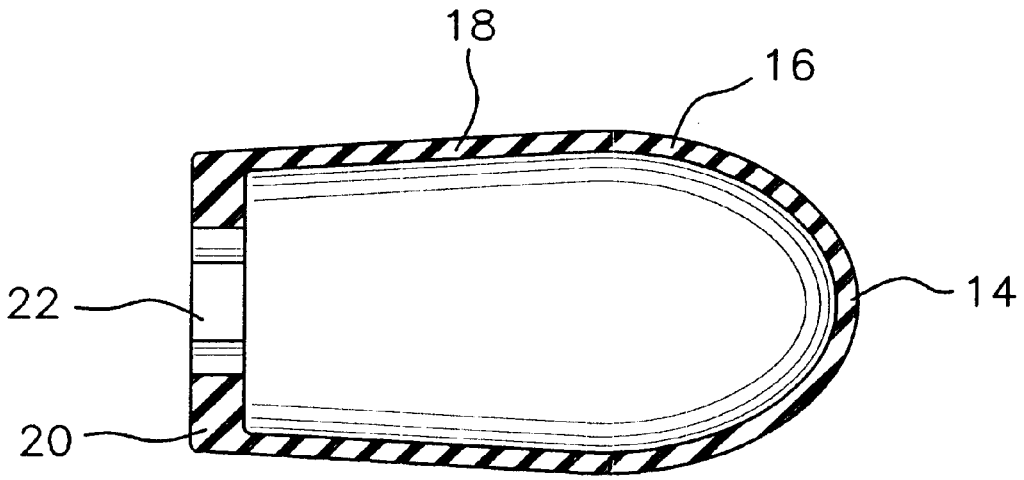
FIG. 4 is a schematic cross-sectional view taken along line 4—4 of the present invention.

With reference now to the drawings, and in particular to FIGS. 1 through 4 thereof, a new pacifier cover embodying the principles and concepts of the present invention and generally designated by the reference numeral 10 will be described.

As best illustrated in FIGS. 1 through 4, the pacifier cover 10 generally comprises a casing 12. The casing 12 has a top wall 14. The top wall 14 has a peripheral edge 16. A peripheral wall 18 is integrally coupled to and extends away from the peripheral edge 16 of the top wall 14. The peripheral wall 18 has a free edge 20. The free edge 20 defines an opening 22 into the casing 12. The peripheral wall 18 tapers from the top wall 14 toward the free edge 20. The opening has a generally oval shape such that the opening 22 has a first diameter preferably equal to 1½ inches plus or minus ¼ inches and a second diameter preferably equal to 1¼ inches plus or minus ¼ inches. The top wall 14 has a bulbous shape such that an outer surface of the top wall 14 is generally convex. A distance from the opening 22 to an apex of the top wall 14 is substantially equal to 2¼ inches plus or minus ½ inch. The casing 12 is preferably comprised of a resiliently elastic material which is ideally an elastomeric material. A plurality of fingers 24 are integrally coupled to the free edge 20 and extend towards each other.

In use, a pacifier 30 may be extended through the opening 22 and into the casing 12. The fingers 24 releasably hold the pacifier 30 in the casing 12. The casing 12 protects the nipple of pacifier from contaminants.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pacifier cover device for covering and protecting a pacifier, said device comprising:

a casing, said casing having a top wall, said top wall having a peripheral edge, a peripheral wall being integrally coupled to and extending away from said peripheral edge of said top wall, said peripheral wall having a free edge, said free edge defining an opening into said casing, said casing being comprised of a resiliently elastic material, said peripheral wall tapering from said top wall toward said free edge;

wherein the pacifier may be extended through said opening and into said casing; and wherein said opening has a generally oval shape such that said opening has a first diameter substantially equal to 1½ inches and a second diameter substantially equal to 1¼ inches.

2. The pacifier cover device as in claim 1, wherein said top wall has a bulbous shape such that an outer surface of said top wall is generally convex.

3. The pacifier cover device as in claim 2, wherein a distance from said opening to an apex of said top wall is substantially equal to 2¼ inches.

4. The pacifier cover device as in claim 2, further comprising a plurality of fingers being integrally coupled to said free edge and extending towards each other.

5. The pacifier cover device as in claim 1, further comprising a plurality of fingers being integrally coupled to said free edge and extending towards each other.

6. A pacifier cover device for covering and protecting a pacifier, said device comprising:

a casing, said casing having a top wall, said top wall having a peripheral edge, a peripheral wall being integrally coupled to and extending away from said peripheral edge of said top wall, said peripheral wall having a free edge, said free edge defining an opening into said casing, said peripheral wall tapering from said top wall toward said free edge, said opening having a generally oval shape such that said opening has a first diameter substantially equal to 1½ inches and a second diameter substantially equal to 1¼ inches, said top wall having a bulbous shape such that an outer surface of said top wall is generally convex, a distance from said opening to an apex of said top wall being substantially equal to 2¼ inches, said casing being comprised of a resiliently elastic material;

a plurality of fingers being integrally coupled to said free edge and extending towards each other; and wherein the pacifier may be extended through said opening and into said casing, wherein said fingers releasably hold said pacifier in said casing.

7. A pacifier cover device for covering in protecting a pacifier, said device comprising:

a casing, said casing having a top wall, said top wall having a peripheral edge, a peripheral wall being integrally coupled to and extending away from said peripheral edge of said top wall, said peripheral wall having a free edge, said free edge defining an opening into said casing, said casing being comprised of a resiliently elastic material;

a plurality of fingers being integrally coupled to said free edge and extending towards each other;

wherein the pacifier may be extended through said opening and into said casing; and said opening having a generally oval shape such that said opening has a first diameter substantially equal to 1½ inches and a second diameter substantially equal to 1¼ inches.

8. The pacifier cover device as in claim 7, wherein said casing further comprises:

said peripheral wall tapering from said top wall toward said free edge.

9. The pacifier cover device as in claim 7, wherein said casing further comprises:

said top wall having a bulbous shape such that an outer surface of said top wall is generally convex.

10. The pacifier cover device as in claim 9, wherein said casing further comprises:

a distance from said opening to an apex of said top wall being substantially equal to 2¼ inches.

* * * * *